US009052079B2

(12) United States Patent
O'Neill

(10) Patent No.: US 9,052,079 B2
(45) Date of Patent: Jun. 9, 2015

(54) SIMULATED FLAME EFFECT FIRE

(71) Applicant: Basic Holdings, Cloghran, Dublin (IE)

(72) Inventor: Noel O'Neill, Drogheda (IE)

(73) Assignee: Basic Holdings, Cloghran, Dublin (IE)

( * ) Notice: Subject to any disclaimer, the term of this patent is extended or adjusted under 35 U.S.C. 154(b) by 0 days.

(21) Appl. No.: 14/541,523

(22) Filed: Nov. 14, 2014

(65) Prior Publication Data

US 2015/0068079 A1 Mar. 12, 2015

Related U.S. Application Data

(63) Continuation-in-part of application No. PCT/EP2013/059959, filed on May 14, 2013.

(30) Foreign Application Priority Data

May 15, 2012 (GB) ..... 1208450.5

(51) Int. Cl.
*G09F 19/12* (2006.01)
*F21S 10/04* (2006.01)
*F24C 7/00* (2006.01)

(52) U.S. Cl.
CPC ..... *F21S 10/043* (2013.01); *G09F 19/12* (2013.01); *F24C 7/004* (2013.01)

(58) Field of Classification Search
CPC ..... F24B 1/1808; F24C 7/004; F24C 3/006; F21S 10/04; G09F 19/12
USPC ..... 40/428
See application file for complete search history.

(56) References Cited

U.S. PATENT DOCUMENTS

| | | | | | |
|---|---|---|---|---|---|
| 3,811,817 | A * | 5/1974 | Mansnerus et al. | 431/126 |
| 4,126,408 | A * | 11/1978 | Cox | 431/2 |
| 4,487,572 | A * | 12/1984 | Parker | 431/331 |
| 4,526,530 | A * | 7/1985 | Menter et al. | 431/34 |
| 4,557,687 | A * | 12/1985 | Schirneker | 431/291 |
| 5,591,395 | A | 1/1997 | Schroeder et al. | 422/4 |
| 7,967,690 | B2 * | 6/2011 | O'Neill | 472/65 |
| 8,574,086 | B2 * | 11/2013 | O'Neill | 472/65 |
| 2003/0041491 | A1 * | 3/2003 | Mix | 40/428 |
| 2004/0257798 | A1 * | 12/2004 | Hart et al. | 362/96 |

(Continued)

FOREIGN PATENT DOCUMENTS

| | | | | |
|---|---|---|---|---|
| DE | 10051789 | A1 | 5/2002 | C04B 38/06 |
| DE | 102010050858 | A1 | 5/2012 | A63J 5/00 |
| GB | 2418014 | A | 3/2006 | F24C 7/00 |
| GB | 2436212 | A | 9/2007 | F24C 7/00 |
| GB | 2460453 | A | 12/2009 | F24C 7/00 |

OTHER PUBLICATIONS

International Search Report from corresponding International Patent Application No. PCT/EP2013/059959, dated Aug. 9, 2013.

(Continued)

*Primary Examiner* — Shin Kim
(74) *Attorney, Agent, or Firm* — Kusner & Jaffe

(57) ABSTRACT

A simulated flame effect fire comprising a liquid reservoir for containing liquid; at least one wick having a portion thereof configured for contact with the liquid; a heating element arranged relative to another portion of the at least one wick for evaporating liquid in the wick, thereby generating vapor; a light source arranged relative to the at least one wick for illuminating the vapor from the wick to generate simulated flame effects; and a fuel bed located such that the generated simulated flame effects appear to originate from the fuel bed.

51 Claims, 9 Drawing Sheets

(56) References Cited

U.S. PATENT DOCUMENTS

| | | | | |
|---|---|---|---|---|
| 2006/0115386 | A1* | 6/2006 | Michaels et al. | 422/123 |
| 2009/0088263 | A1 | 4/2009 | O'Neill | 472/65 |
| 2010/0299980 | A1* | 12/2010 | Betz et al. | 40/428 |
| 2011/0250978 | A1* | 10/2011 | O'Neill | 472/65 |

OTHER PUBLICATIONS

International Preliminary Report on Patentability (IPRP) from corresponding International Patent Application No. PCT/EP2013/059959, dated Dec. 18, 2014, including the Written Opinion of the International Searching Authority.

Website print out of "Smoke Generator," Aug. 30, 2011, https://web.archive.org/web/20110830085038/http://wmunderway.8m.com/cont/smoke/smoke.htm, print out date, Dec. 29, 2014, (reference D7 in the IPRP).

International Preliminary Report on Patentability from corresponding International Patent Application No. PCT/EP2013/059959, dated Nov. 18, 2014, including the Writeen Opinion of the International Searching Authority.

* cited by examiner

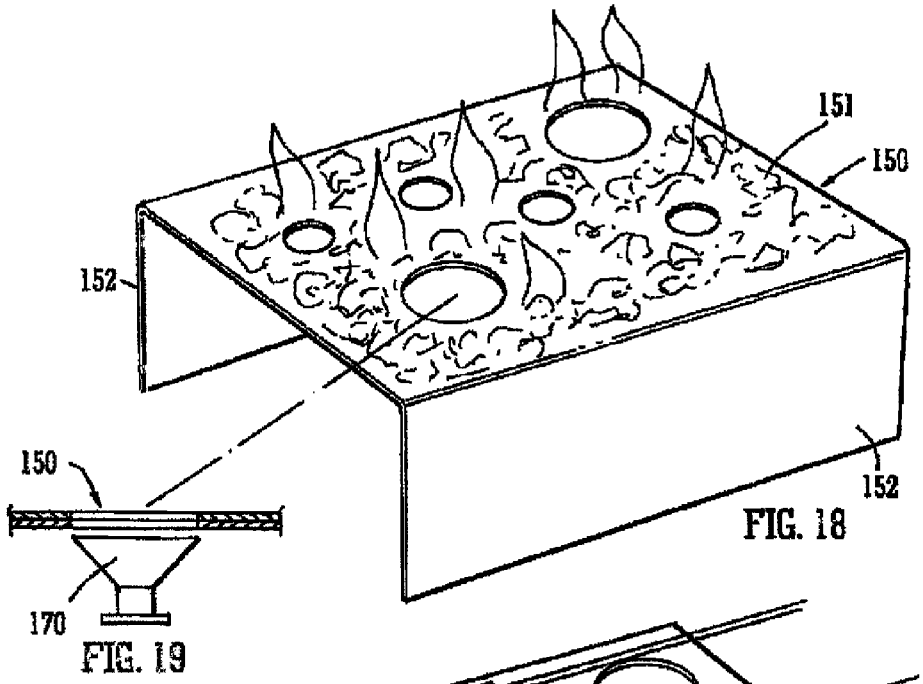
FIG. 18
FIG. 19
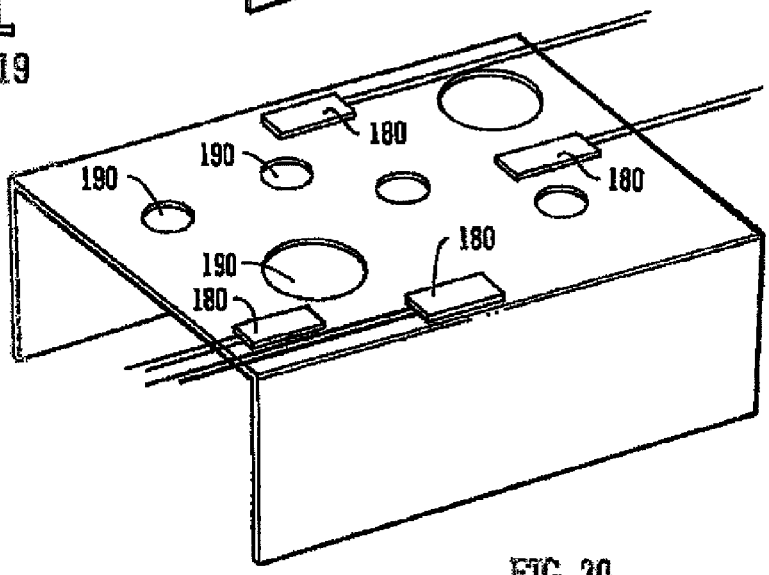
FIG. 20

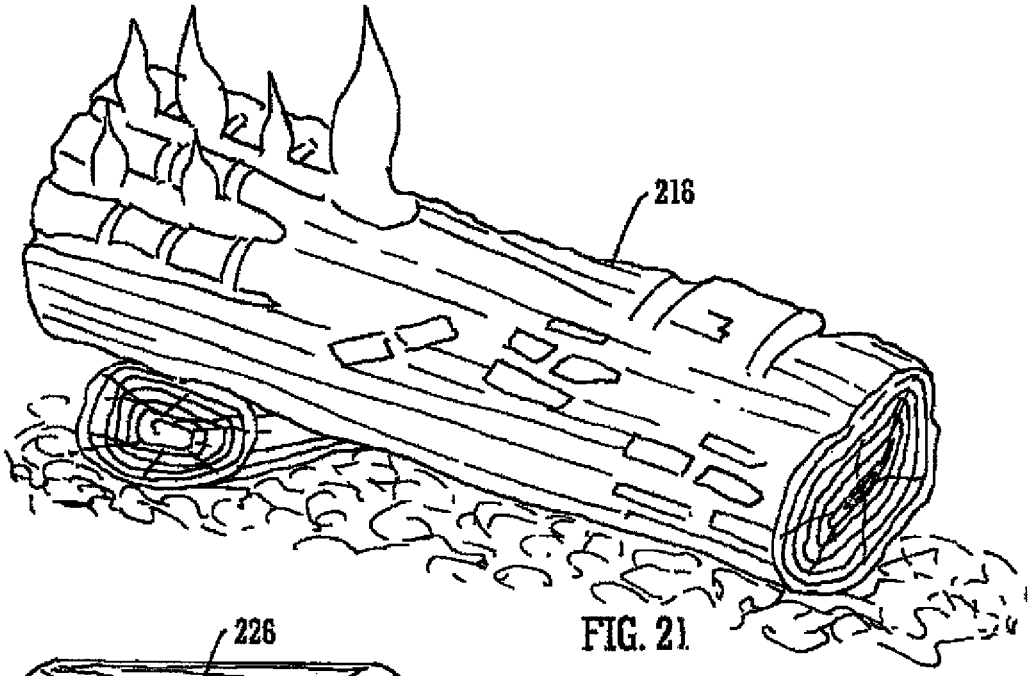
FIG. 21
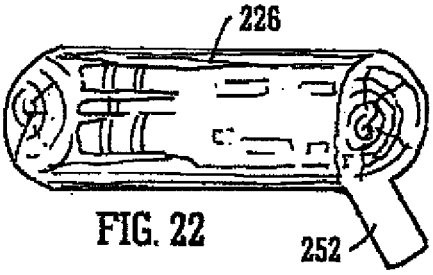
FIG. 22
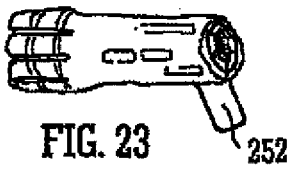
FIG. 23
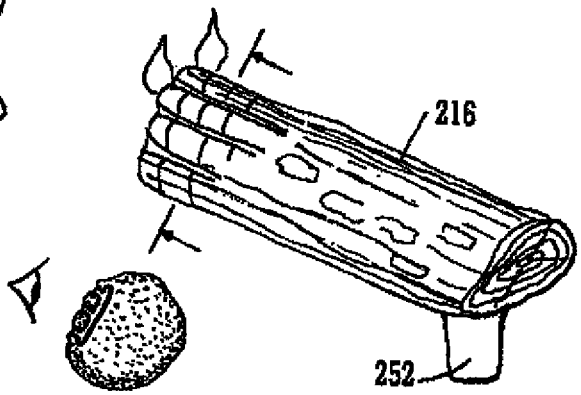
FIG. 27
FIG. 26
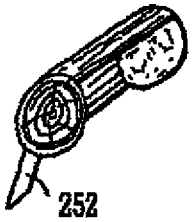
FIG. 24
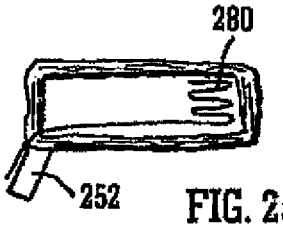
FIG. 25

SIMULATED FLAME EFFECT FIRE

RELATED APPLICATIONS

This application is a continuation-in-part (CIP) of International Application No. PCT/EP2013/059959, filed on May 14, 2013, which claims priority from United Kingdom Patent Application No. GB 1208450.5, filed on May 15, 2012, said applications fully incorporated herein by reference.

FIELD OF THE INVENTION

The present invention relates to simulated flame effect fires and in particular to a simulated flame effect fire comprising a wick for the generation of a flame effect.

BACKGROUND OF THE INVENTION

Electric fires are well known. Such fires provide a range of simulated flame and/or fuel effects. Typically these effects are generated using one or more mechanical or optical elements to create the visual impression of a burning fire. They are often used in domestic environments where a user wishes to replicate a conventional open fire without having to burn combustible fuel.

There are many ways to provide flame effects within the housing of an electric fire. Known arrangements are useful in generating a flicker effect which is visible on the screen, but there is a continued desire to provide more and more realistic effects which can be generated in a manner whereby the user of the fire is not aware of the means used to create the effects.

It is known to provide electric fires with flame effect simulators which are usefully employed to generate flame effects within an interior of the electric fire such that a user gets the visual impression of a fire burning within the fire. Such flame effect simulators are typically combined with an artificial fuel bed which provides for a simulation of the combustible material that is employed within the electric fire.

One example of a known electric fire is GB 2460453 co assigned to the present assignee. This document describes a steam generator whereby water is stored in a liquid reservoir and is then drawn into a steam generator where it is boiled to form steam. This steam exits the steam generator as a curtain of steam onto which light is directed. Problems associated with using steam in the generation of a flame effects include the fact that the steam itself comprises large molecules or droplets of water whose number is not sufficient and whose size does not lend well to forming distinct and discernible individual flames. Furthermore the actual steam is generally visible-similarly to how one can view the steam emitting from a kettle when it is boiling which can detract from the overall effect. Another disadvantage relates to the noise generated by boiling water to form steam which can again detract from the overall effect desired. Another disadvantage is the volume of water that is required in the liquid reservoir to ensure an adequate supply of steam during the use of the fire, the boiling of the water can cause the reservoir to deplete quite quickly.

Therefore while the fires described in many of the prior art arrangements for simulating the fuel and flames of a solid fuel fire provide a very pleasant, interesting and realistic effect, there remains room for improvement.

SUMMARY OF THE INVENTION

These and other problems are addressed in accordance with the teaching of the present invention by one or more of the following exemplary arrangements. While being described with reference to different embodiments it will be understood that elements of features of one embodiment can be used with or interchanged for elements of features of another embodiment without departing from the teaching of the invention which is to be construed as being limited only insofar as is deemed necessary in the light of the appended claims.

Accordingly, the present teaching provides a flame effect fire as detailed in the independent claim(s). Advantageous features are provided in dependent claims.

BRIEF DESCRIPTION OF THE DRAWINGS

The present invention will now be described with reference to the accompanying drawings in which:

FIG. 12 is a side view of a flame effect fire comprising a planar wick module, according to an embodiment;

FIG. 13 is a perspective view of the wick module of FIG. 12 with a heater placed on the wick;

FIG. 14 is a perspective view of the assembled wick module of FIG. 12 according to an embodiment;

FIG. 15 is a view of a wick module having a printed surface representing ash, according to an embodiment of the present teaching;

FIGS. 18 to 20 illustrate an alternative embodiment of a wick module wherein the wick itself forms part or all of the fuel bed;

FIGS. 21 to 25 illustrates the forming of a fuel bed element using wick absorbing material;

FIG. 21 shows a fuel bed element with flames coming out of selective areas of a surface of the fuel bed element;

FIG. 22 shows a material blank with printing on the surface thereof;

FIG. 23 and FIG. 24 illustrate a process of heat forming the fuel bed element of FIG. 21, with ends, front, top and bottom portions of the fuel bed element partially wrapped;

FIG. 25 shows a heating element for evaporating moisture in selective areas of the fuel bed element;

FIG. 26 and FIG. 27 show the spongy-like fuel bed element with heating elements inserted in selective areas;

DETAILED DESCRIPTION OF THE INVENTION

Various aspects of the illustrative embodiments will be described using terms commonly employed by those skilled in the art to convey the substance of their work to others skilled in the art. However, it will be apparent to those skilled in the art that alternate embodiments may be practiced with only some of the described aspects. For purposes of explanation, specific numbers, materials, and configurations are set forth in order to provide a thorough understanding of the illustrative embodiments. However, it will be apparent to one skilled in the art that alternate embodiments may be practiced without the specific details. In other instances, well-known features are omitted or simplified in order not to obscure the illustrative embodiments.

Furthermore features or integers described with reference to one embodiment may be interchanged with or replaced by those of another embodiment without departing from the teaching of the invention. Where embodiments or elements within Figures are described with reference to other embodiments or elements within other Figures it will be understood that those embodiments or elements may be usefully employed within the arrangements described in the other embodiments or Figures. It is not intended to imply that such embodiments or Figures require the operation of the other embodiments of Figures to function in that it is intended that certain embodiments or Figures may be operable independently of other embodiments or Figures.

Figure 1:
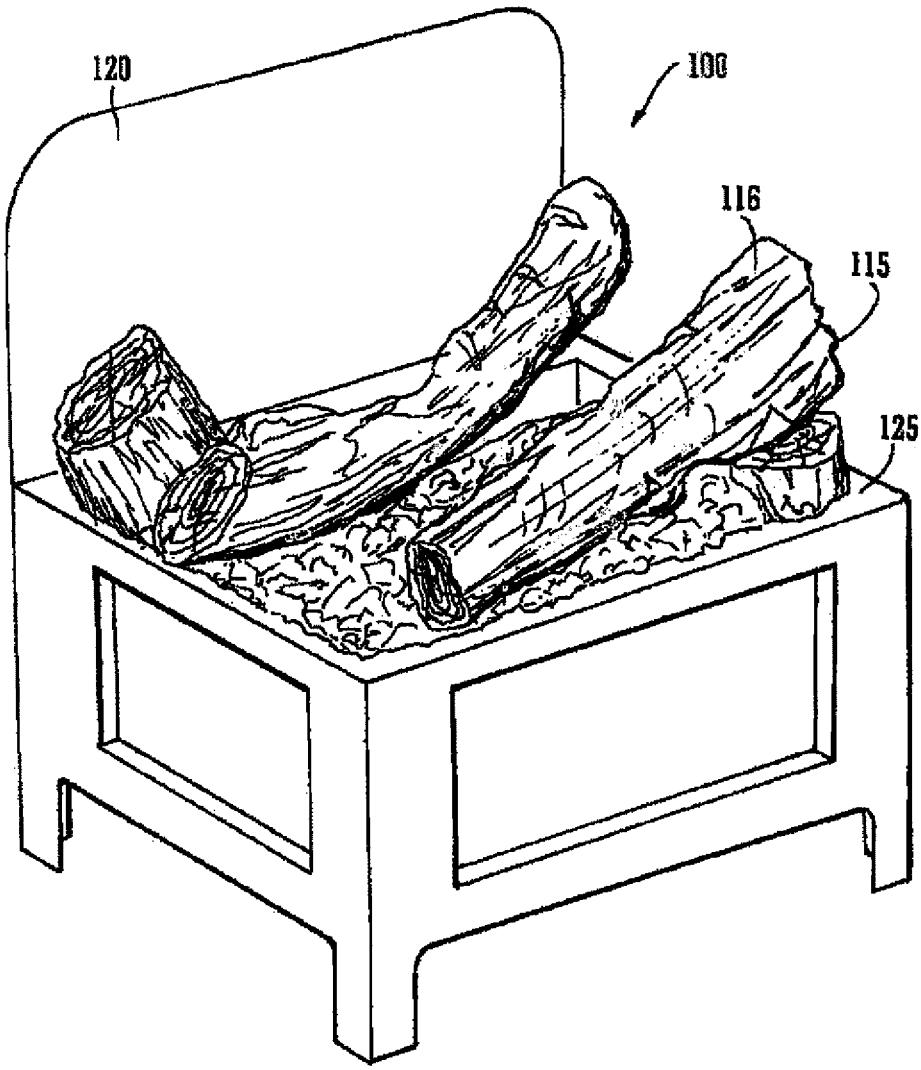
FIG. 1 is a perspective view of a flame effect fire including a fuel bed according to the present teaching.

FIG. 1 is a perspective view of an example of a flame effect fire 100 including a fuel bed 115 according to the present teaching. The fire 100 may include an area within which one or more of flame and/or fuel effects may be generated. The exemplary fuel bed 115 may include a number of fuel bed elements 116—in this example shaped to resemble solid fuel such as logs or coal, which will be described in more detail later. The fire of FIG. 1 may include a planar wall 120 disposed behind the fuel bed 115. This may be patterned or otherwise textured to replicate a conventional fire insert.

According to the present teaching, the fire utilizes the capillary action of a wick in communication with a liquid reservoir, a light source, and a heating element to generate illuminated vapor. By generating one or more flame effects through the interaction of the generated vapor with a lighting effect, the perception to the viewer is of a three dimensional flame that appears to originate from the fuel bed 115. Preferably the wick, light source, and heating element are hidden from view of the viewer of the fire, so that the viewer only sees the fuel bed and the illuminated vapor rising therefrom.

Figure 8:
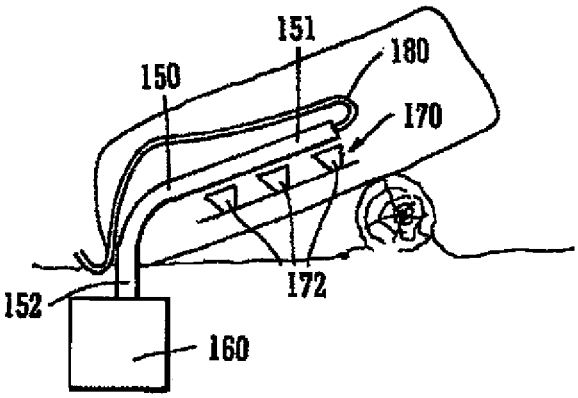
FIGS. 8 and 9 show the wick module embedded within the log, according to an embodiment.

Referring to FIG. 8, the fire may include a wick 150 comprising a reservoir proximal end 152 and a reservoir distal end 151. The proximal end 152 may be disposed in a liquid reservoir 160 containing liquid, typically water. The distal end 151 of the wick 150 may be exposed outside of the liquid. The liquid reservoir 160 may be disposed underneath a base of the fuel bed and is accessible to a user to allow for replenishment of the liquid after use of the fire. Although not illustrated, the liquid reservoir 160 may be replenished with liquid from another secondary reservoir or supply. It will be appreciated that the liquid in the liquid reservoir 160 moves through capillary action in the wick 150 from the proximal end 152 in the liquid towards the free distal end 151. The wick 150 may comprise a porous material. The specifics of the material used for the wick is not important as the person of skill will be able to select one or more materials depending on the wicking rate required. The wick provides a medium through which liquid may travel. On reaching the distal end of the wick, the liquid in the distal end 151 of the wick 150 may be then evaporated thereby generating vapor. It will be appreciated that the liquid evaporates in the form of tiny droplets which differ in size from the type of droplets that are conventionally found in steam. The temperature of this evaporative vapor is also generally relatively low, and lower than would be expected from an outlet from a steam generator using a boiling of water.

A light source 170 is provided relative to the distal end 151 of the wick 150 and is configured to illuminate the generated vapor from the distal end 151 of the wick 150. This may be caused by having the light proximally located to the wick albeit this is not essential. What is important is that light from the light source may be directed onto the vapor that is generated from the wick. In order to accelerate the evaporation rate of the liquid in the wick 150, the distal end 151 of the wick 150 may be heated by a heating element 180 provided relative to the distal end 151 of the wick 150. It will be appreciated therefore that the heating element 180 provides an accelerated evaporation rate of liquid in comparison to what would be a normal evaporation rate at room temperature. The light source 170 and/or the heating element 180 may be battery-powered or powered by an electrical power source disposed external to the fire.

Figure 6:
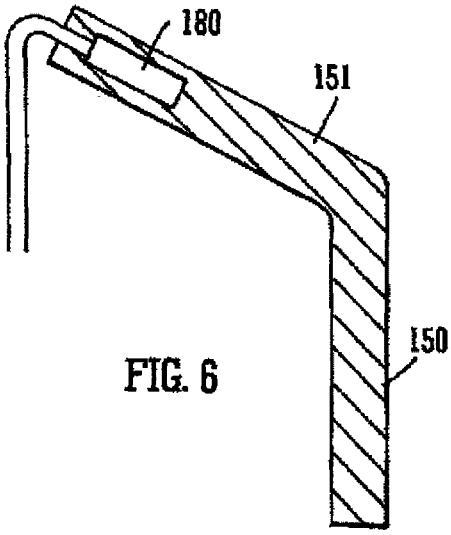
FIG. 6 is a sectional view showing the wick in contact with the heat source.

The heating element 180 may be disposed proximate to the distal end 151 of the wick 150. It is important that the heating element is sufficiently close to the distal end such that the heat generated by the heat source has an effect on the liquid within the wicking material. This may or may not require intimate contact between the heat source and the wick. If intimate contact is provided this may be through contact on an external surface of the wick. In one embodiment, the heating element 180 may be attached to the distal end 151 of the wick 150. As illustrated in FIG. 6, the heating element 180 may be embedded in the distal end 151 of the wick 150. FIG. 6 also illustrates that the heating element 180 may have a planar shape. The heating element 180 may comprise a low voltage metal ceramic heater. The heat output of the heat source is desirably selected to provide heating only of the wick as opposed to the environment within which the fire is located. This value would typically be of the order of 15 Watts. In another arrangement, the heat source could provide a secondary function, that of heating the actual room within which the fire is located.

Figure 5:
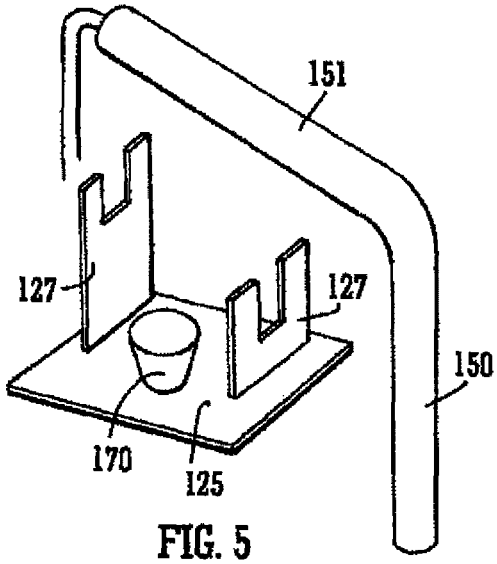
FIG. 5 is a perspective view illustrating a wick module comprising a fixing bracket, a wick, a light source and a heat source, according to an embodiment of the present teaching.
Figure 3:
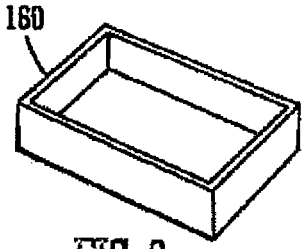
FIG. 3 is a perspective view of a water container.
Figure 2:
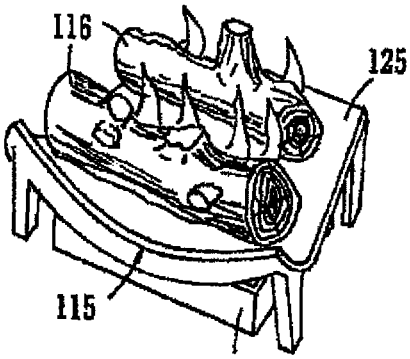
FIG. 2 illustrates a fuel bed with access underneath to a water container.

The wick 150 may be provided in any one of a number of different configurations. For example it may be tubular in shape, and in one arrangement may have a substantially circular cross-sectional shape as illustrated in FIG. 5. In this arrangement, referring to FIG. 5, the light source 170 may be disposed underneath the distal end 151 of the wick 150. Here, the distal end 151 of the wick 150 may be supported on a base 125 of the fuel bed 115 via a fixing bracket 127.

Figure 13:
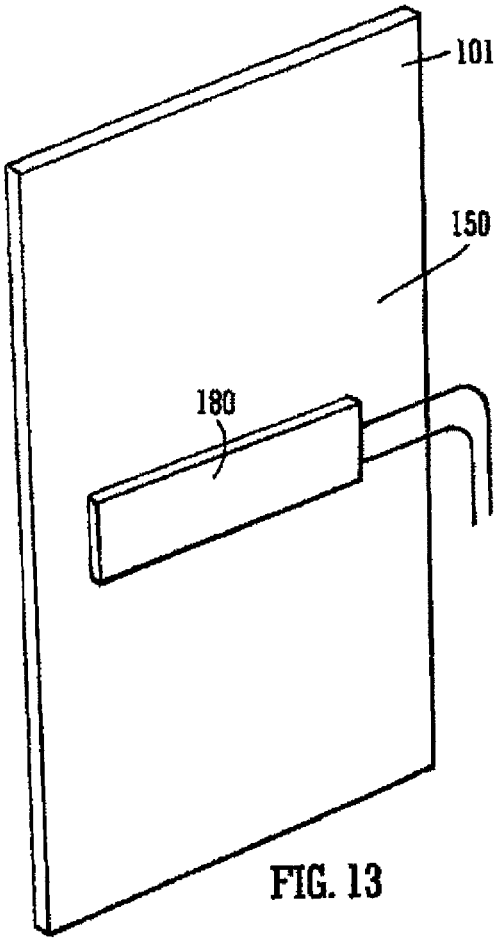
FIGS. 12 to 15 illustrate an alternative wick module wherein the wick has a rectangular planar configuration.
Figure 12:
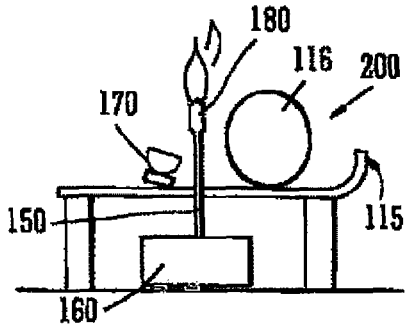
Figure 15:
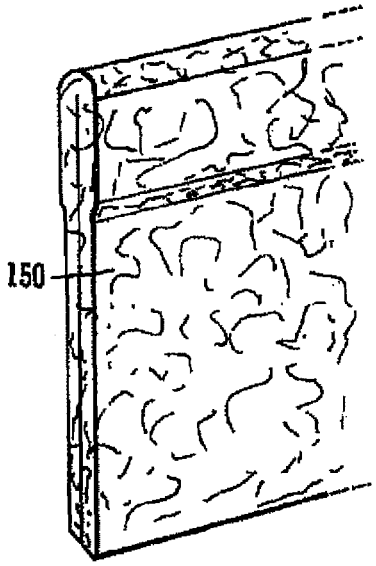
Figure 14:
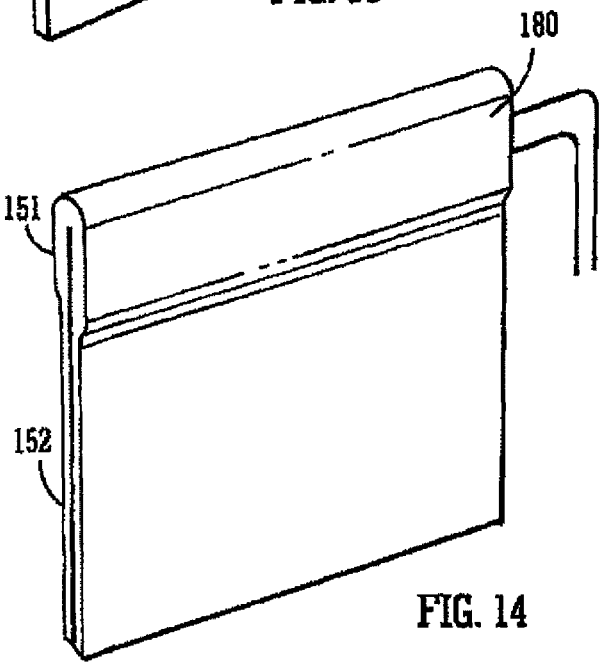

FIGS. 12 to 15 illustrate another embodiment of the wick 150. In this arrangement, the wick 150 may comprise a planar sheet. The planar sheet may be rectangular in shape. It will be understood by one skilled in the art that the bottom portion 152 of the sheet illustrated in these figures constitutes the proximal end of the wick and the top portion 151 constitutes the distal end. FIG. 12 is a side view of a flame effect fire 200 comprising a planar wick module, according to another embodiment of the present teaching. FIG. 13 is a perspective view of the wick 150 of FIG. 12 with a heating element 180 placed on the wick 150. FIG. 14 is a perspective view of the assembled wick 150 of FIG. 12 according to one embodiment. In this embodiment, the wick element 150 is folded over the heating element 180. Referring to FIGS. 13 and 14, the heating element 180 may be coplanar with the wick 150. Thus, it will be appreciated that in the rectangular wick 150 the moisture in the distal end 151 of the wick has easier access to the full surface area of the heating element 180. This facilitates the evaporation of liquid from the distal end 180 of the wick 150 and contributes to providing an accelerated evaporation rate. In another arrangement, as illustrated in FIG. 15, the surface of the wick 150 may be ash-colored. This helps to camouflage the wick module as preferably the wick module is hidden from view of the viewer to the front of the fire. A camouflaged wick may not appear out of place along with other similarly-colored fuel bed elements.

Figure 16:
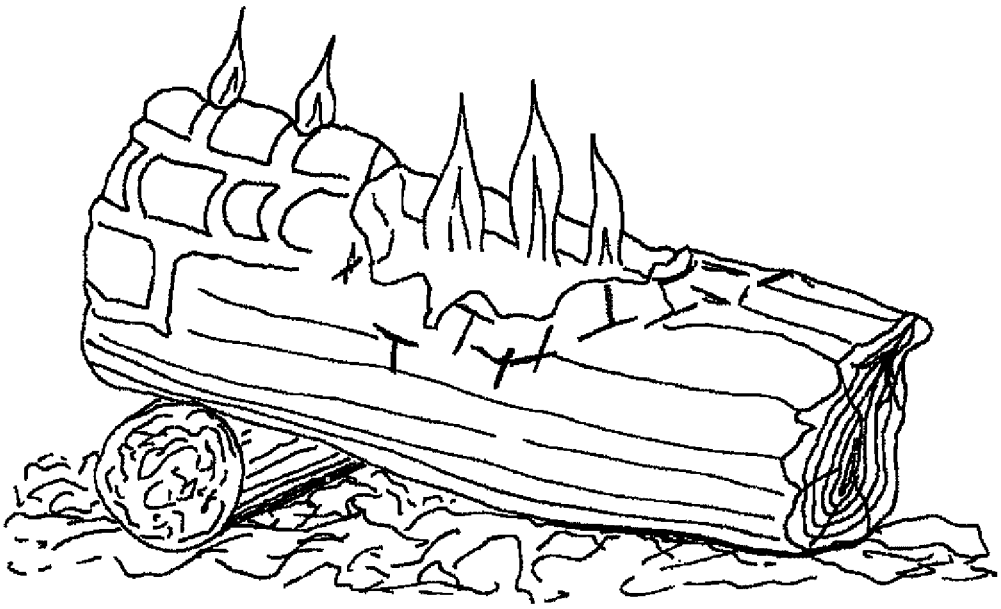
FIGS. 16 and 17 are views of a fuel bed element of a fuel bed, wherein the rectangular wick module is disposed inside the fuel bed element.
Figure 17:
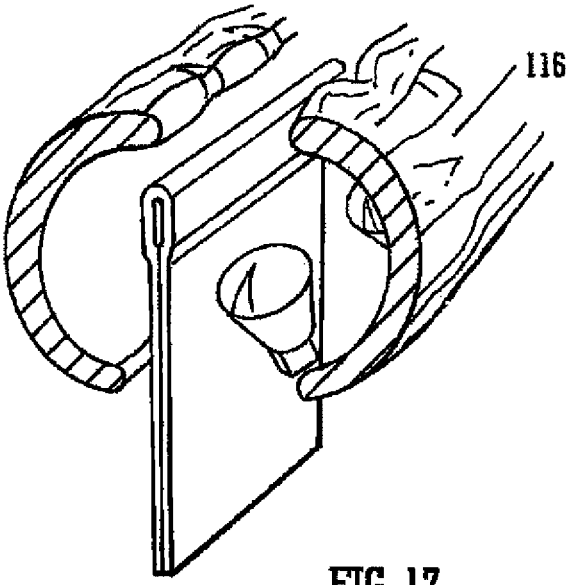

As illustrated in FIGS. 16 and 17, the rectangular wick module may be provided in a fuel bed element 116 with relatively large apertures. FIG. 16 shows a hollow fuel bed element 116 such as a log with large apertures, and FIG. 17 is a cross-sectional view of the hollow fuel bed element 116 containing the rectangular wick module.

FIGS. 18 to 20 illustrate an alternative embodiment of a wick module wherein the wick 150 itself forms part or all of the fuel bed. It will be seen that side portions 152 of the wick constitute the proximal end 152 of the wick 150 disposed in liquid. In this arrangement, fuel effect images, such as images of ashes and debris may be printed onto the surface of the wick 150. Additional portions of resin may be stuck in place on the wick. It will be appreciated that in this embodiment, the wick is two-dimensional and configured such that the wick 150 extends from the front to the rear of the fire. Thus, heater elements 180 may be placed anywhere on the top portion of the wick 150, providing depth to the flame effect.

FIG. 18 shows the wick 150 printed and complete. A plurality of apertures 190 for lights and smaller LEDs may be provided. Accordingly, there is no need for a large aperture for vapor to exit. Moisture can travel from both sides of the wick 150 via the side portions 152. FIG. 19 is a sectional view through the wick 150 showing a light source 170. It will be appreciated that if the light source 170 is close enough to the wick 150 then evaporation may take place around the light source 170 also. In this embodiment, the light source fulfils a dual function, that of a light source and a heating source. In such an arrangement, a dedicated heating element may not be required.

The light source 170 of the fire 100 or 200 may provide a light output directed onto a side of the vapor generated at the distal end 151 of the wick 150. The light source 170 may be located adjacent to the distal end 151 of the wick 150 such that the light is directed upwardly onto the exiting vapor. In an alternative arrangement the light source 170 may be arranged such that the light is directed onto the existing vapor in other directions. By providing for the direction of light onto the vapor, preferential lighting of different regions of the vapor may be effected. The light source 170 may have different colours and/or comprise a plurality of lighting elements 172 as shown in FIG. 8. By using a multicolored light source or by using a plurality of lighting elements such as LEDs it is possible to color grade the illumination of the vapor such that different regions of the vapor are colored differently to other regions. By including a plurality of lighting elements 172 and enabling an individual control of selected ones of that plurality it is possible to create pulsating or flicker effects within the generated illuminated vapor. As the vapor is carried on air currents arising from the heated vapor, it is not necessary for the light source 170 to provide the heating of the air current that carries the vapor. In such an arrangement it is possible to use low voltage or low wattage lighting elements such as LEDs or the like. However, as mentioned above, if the light source 170 is close enough to the wick 150 then accelerated evaporation may take place around the light source 170 also by virtue of the heat produced by the light source 170. Thus the light source may fulfill a dual function, that of a light source and a heating source. In such an arrangement, it will be appreciated therefore that a dedicated heating element may not be required.

Figure 4:
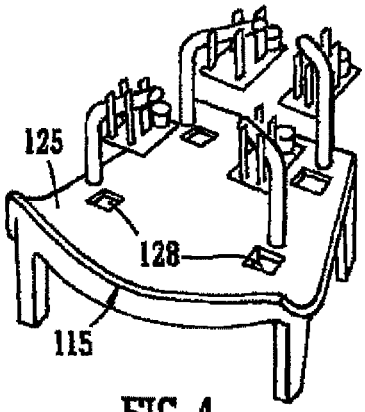
FIG. 4 is a exploded perspective view showing a basic fuel bed with holes therein enabling the wick modules to access the liquid in the container underneath.
Figure 9:
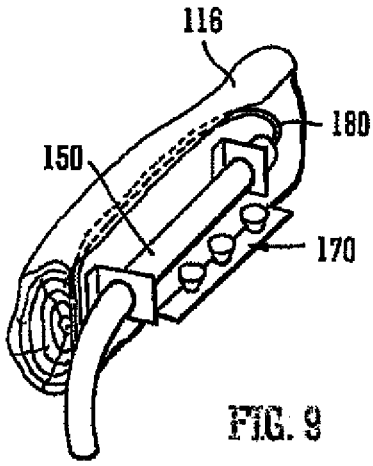
Figure 11:
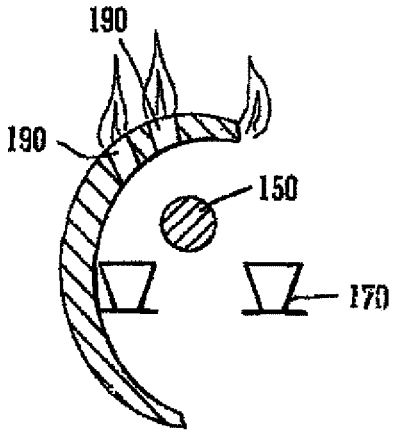

The light source 170 may be configured to be extend along and be parallel with a longitudinal axis of the wick, as illustrated in FIGS. 8 and 9. The light source 170 may be disposed on the fuel bed 115 as illustrated in FIGS. 4, 5, and 12. As illustrated in FIG. 4, a light source 170 may be provided for each of the wick modules. Referring to FIGS. 8 and 11, the light source may be disposed in a fuel bed element 116, for example a log, such that the flame effect appears to originate from the fuel bed element 116. In another arrangement described below, the light source 170 may be used in conjunction with wave guides in fuel bed elements 116 of the fuel bed 115.

Figure 7:
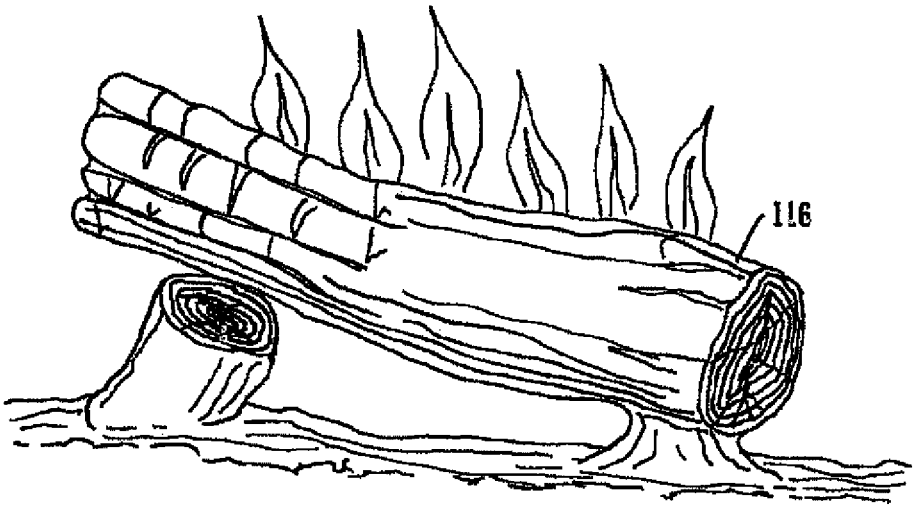
FIG. 7 is a view of a fuel bed element of a fuel bed, the wick module being arranged relative to the fuel bed element thus simulating a flame effect.
Figure 10:
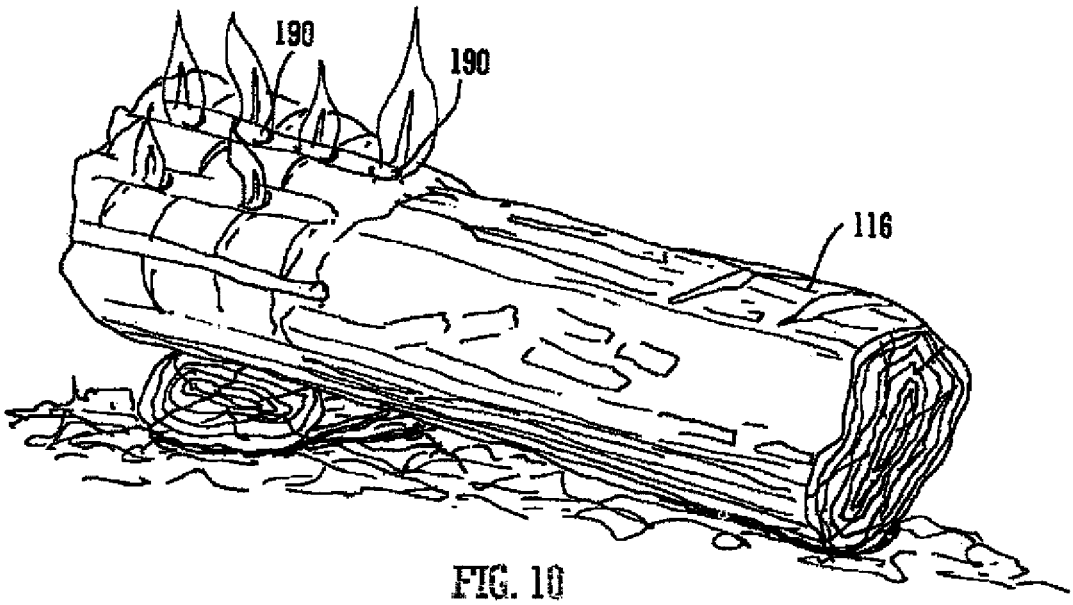
FIGS. 10 and 11 are views of a fuel bed element of a fuel bed, wherein the wick module is disposed inside the fuel bed element, the fuel bed element having holes representing burnt portions.

As mentioned above, the fuel bed 115 may comprise one or more fuel bed elements 116, for example logs or pieces of coal. The one or more fuel bed elements 116 may be disposed on the base 125 of the fuel bed 115. FIG. 7 is a view of a fuel bed element 116 of the fuel bed 115, the wick arrangement being disposed relative to the fuel bed element 116 thus simulating a flame effect. FIGS. 8 and 9 show a wick module comprising a wick 150, a light source 170 and a heating element 180. FIG. 10 and FIG. 11 illustrate a wick module placed inside a portion of a fuel bed element 116 such as log. The log may comprise holes 190 representing burnt sections. Some light and vapor may exit giving the impression the log has caught fire. Preferably, the wick module is configured to be hidden to a viewer of the fire. The wick module may be attached to the fuel bed element 116, as illustrated in FIG. 9, or embedded within the fuel bed element 116, as shown in FIGS. 8 and 11. Referring to FIG. 8, the proximal end 152 of the wick 150 may be in contact with the liquid in the reservoir 160. Where the wick module is embedded in the fuel bed element 116, one or more apertures 190 may be formed in the fuel bed element 116 for allowing the generated vapor to escape. Additionally, one or more apertures 128 may be formed in the base 125 of the fuel bed 115 for allowing the wicks 150 to access the liquid in the liquid reservoir 160. This is illustrated in FIG. 4. In this arrangement it will be appreciated that the one or more apertures 190 in the fuel bed element 116 may be configured to correspond to the one or more apertures 128 formed in the base 125 of the fuel bed 115. In this embodiment, the liquid reservoir 160 is located beneath the fuel bed 115.

It will be appreciated that each fuel bed element 116 may comprise one or more such wick modules. In one embodiment, each fuel bed element 116 may comprise a single wick module. In another configuration, a single wick module may be provided to the rear of a fuel bed 115 comprising multiple fuel bed elements 116. Where a plurality of wicks are used, a common liquid reservoir 160 may be utilized in which the proximal end 152 of each of the wicks 150 is disposed. It will also be understood that a single heating element 180 may be provided for the plurality of wicks 150. Alternatively, a common heating element 180 may be provided for each of the plurality of wicks 150. Further, a heating element 180 may be provided for a respective one or more of each of the wicks 150.

In another embodiment, the fuel bed element may be formed of a wick absorbing material. Thus, in this embodiment, the fuel bed element constitutes the wick. FIGS. 21 to 25 illustrate the forming of a fuel bed element 216 such as a log using wick absorbing material. FIG. 21 shows a fuel bed element with flames coming out of selective areas of a surface of the log. As illustrated in FIGS. 22-24, the log may be formed from a material blank 226 with fuel effect images printed on the surface thereof. Then the fuel bed element 216 is heat formed with ends, front, top and bottom portions of the log partially wrapped. A projection 252 constituting the proximal end of the wick may be formed at one end of the fuel bed element 216, preferably configured to be insertable in the liquid reservoir. A heating element 280 for evaporating moisture in selective areas of the fuel bed element may be integrated in the fuel bed element 216. FIG. 26 and FIG. 27 show the final spongy-like fuel bed element 216 with the heating elements inserted in selective areas.

When the fuel bed is comprised of one or more fuel bed elements, a light source may be provided at one end of each of the fuel bed elements. Internal surfaces of the fuel bed element may function as a waveguide to distribute the light throughout the fuel bed element. Thus, the fuel bed element will be illuminated thereby providing a more realistic fuel effect as well as illuminating vapor generated from the wick.

In another arrangement of the fuel bed, the light source may be at least partially located within the fuel bed. The fuel bed may be moveable relative to an electrical connection to the light source. In this regard, a connector which may be unplugged from the light source thereby operably allowing the light source to be separated from its power source and move with the fuel bed may be utilized. Alternatively, the fuel bed may be configured to be seated over the light but moveable relative to the light source such that on moving the fuel bed, the light is exposed.

Figure 28:
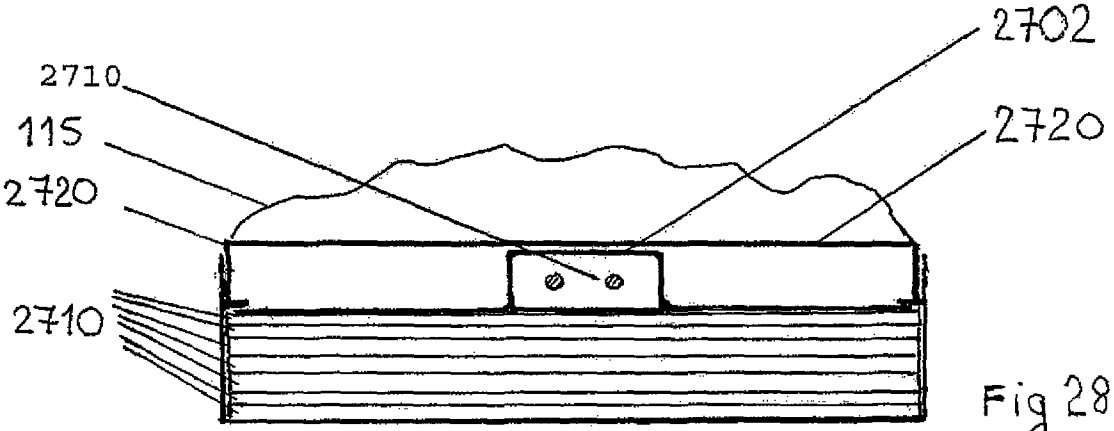
FIG. 28 is a section through another wicking arrangement provided in accordance with the present teaching.
Figure 29:
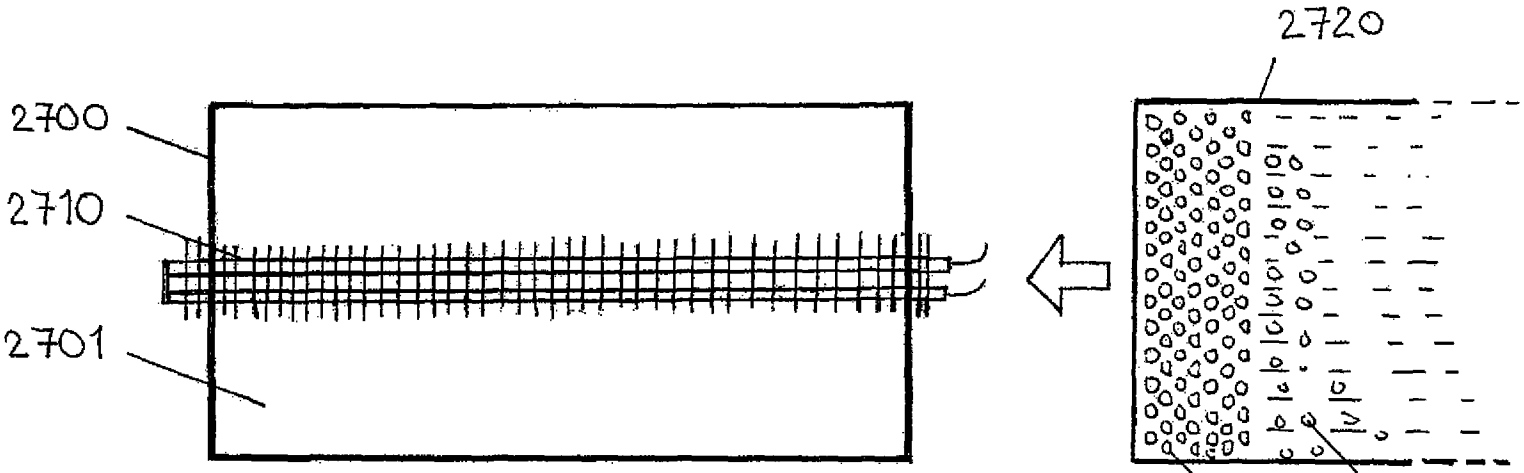
FIG. 29 is a plan view of the wicking arrangement of FIG. 28.

FIGS. 28 and 29 show another example of a wicking arrangement provided in accordance with the present teaching. In this configuration a tray or other open topped container 2700 is provided. The container 2700 provides a bath within which a volume of liquid can be provided. A plurality of individual sheets of wicking material 2701 are locatable in the container. The outer dimensions of the individual wicking sheets 2701 are desirably substantially equivalent to the inner dimensions of the container 2700. In this way, when viewed in plan view such as that shown in Figure FIG. 29, the sheets 2701 substantially occupy the area defined by the X-Y dimension of the container 2700.

The plurality of sheets 2701 can be layered in the container. Each of the sheets may be provided in a multi-ply material. For example, each sheet may have a thickness of 30 mm as fabricated from six plies each having a thickness of 5 mm. The purpose of the sheets 2701 is to absorb the liquid in the container such that when the sheets are provided into the container, the liquid is absorbed into the volume of the sheets and as a result, the container can be shaken about without spillage of the liquid.

To effect a wicking of liquid from the sheets of wicking material a heater 2710 is provided on top of the first layer of wicking sheets 2701. In this arrangement, the heater is a finned heating element that extends across the width of the container 2700 or at least part of the container. The heater may comprise multiple fins that extend transverse to the longitudinal axis of the heater. The heater may be rested on the wicking material so as to be in contact with the wicking material 2701 but could also be independently supported so as to avoid compression of the wicking material 2701 due to the weight of the heater 2710.

At least one other sheet 2702 of wicking material can be provided on top of the heater so as to define an upper layer of wicking material sheets. The schematic of FIG. 28 shows one sheet 2702 but multiple sheets could also be provided. This upper sheet 2702 may have the same dimensions as the lower sheets 2701 or could be made slightly thinner—for example 2 mm thickness. It is dimensioned to fit at least over and cover the top and sides of the heater 2710. The upper layer sheet is also dimensioned to be in contact with the lower sheets 2701 when placed over the heater 2710 so as to allow liquid wick from the lower sheets into the upper sheet. In this configuration it will be appreciated that the wicking material forms a stack within the container, the heater being provided within the stack. The heater is effectively sandwiched within a plurality of layers of wicking material.

Having located the heater and the wicking sheets within the container a perforated grid 2720 formed from for example a steel mesh having a plurality of apertures 2730 stamped or otherwise formed in a solid upper surface 2725 may be placed on top of the container. The dimensions of the aperture allow mist that is generated by the heating of the wicking material to pass through the grid.

The grid 2720 allows location of loose pebbles or other fuel bed elements 115 to be placed over the container without falling into the container. If the fuel bed elements 115 are suitably dimensioned—for example may be seated on the edge of the container—a grid may be dispensed with. In certain configurations, the fuel bed elements are perforated to allow passage of the vapor through the fuel bed elements.

Similarly to the other arrangements described above, in this configuration one or more light sources may be directed onto the rising mist to give an illusion of flames. The light sources may be pulsed or otherwise modulated to give different flame impressions.

To refill the container it is not necessary to empty the wicking sheets out of the container—liquid can simply be poured into the container where it will be immediately absorbed by the wicking sheets.

By using a wicking effect to generate evaporative vapor the present teaching advantageously provides a solution as to how to provide a sufficient volume of vapor that can be provided in an evaporated form with a sufficiently large number of individual liquid droplets that can be directed to a chosen point so as to give the appearance of a well-defined and full flame body.

By providing a plurality of wicks distributed throughout the fire, the present teaching provides individual flame effects within the fire, each being associated with an individual wick. Furthermore by using a wick with many strands it is possible to provide increased an surface area for evaporation to take place and also allows the utilisation of air pockets in which moist air movement can take place to improve the flame effect. By using a heater in contact with a planer surface of the wick it is possible to extend the evaporative surface of the wick to increase the surface area from which water vapor can be generated. This heater can be heated up to temperatures of typically about 70 degrees centigrade which increases the rate of evaporation, but not at boiling temperatures. As the vapor temperature is relatively low there quickly forms a temperature drop due to surrounding air which generates tiny water droplets suspended in the airflow that refract the light and give a really good flame shape.

The combination of the heated wick in the context of a fuel bed and then directing light onto the evaporative vapor generates realistic flame effects that appear to originate from the fuel bed. The use of wicks allows a judicious and accurate location of these flame effects as the wicks can be accurately placed relative to the fuel bed.

Although specific embodiments have been illustrated and described herein for purposes of description of the preferred embodiment, it will be appreciated by those of ordinary skill in the art that a wide variety of alternate and/or equivalent implementations may be substituted for the specific embodiment shown and described without departing from the scope of the present invention. Those with skill in the art will readily appreciate that the present invention may be implemented in a very wide variety of embodiments. This application is intended to cover any adaptations or variations of the embodiments discussed herein. Therefore, it is manifestly intended that this invention be limited only by the claims and the equivalents thereof.

The words comprises/comprising when used in this specification are to specify the presence of stated features, integers, steps or components but does not preclude the presence or addition of one or more other features, integers, steps, components or groups thereof.

Having described the invention, the following is claimed:

1. A simulated flame effect fire comprising:

a liquid reservoir for containing liquid;

at least one wick having a portion thereof configured for contact with the liquid;

a heating element arranged relative to another portion of the at least one wick for evaporating liquid in the wick, thereby generating vapor;

a light source arranged relative to the at least one wick for illuminating the vapor from the wick to generate simulated flame effects; and a fuel bed located such that the generated simulated flame effects appear to originate from the fuel bed.

2. The flame effect fire of claim 1, wherein the heating element operably accelerates an evaporation rate of the liquid in the at least one wick.

3. The flame effect fire of claim 1, wherein a proximal end of the wick is configured to contact the liquid in the liquid reservoir, and a distal end of the wick is disposed relative to the heating element.

4. The flame effect fire of claim 3, wherein the heating element is disposed proximate to the distal end of the wick.

5. The flame effect fire of claim 1, wherein the heating element is attached to the distal end of the wick.

6. The flame effect fire of claim 5, wherein the heating element is embedded in the distal end of the wick.

7. The flame effect fire of claim 1, wherein the heating element has a planar shape.

8. The flame effect fire of claim 1, wherein the heating element comprises a low voltage metal ceramic heater.

9. The flame effect fire of claim 1, wherein the wick is tubular in shape.

10. The flame effect fire of claim 9, wherein the wick has a substantially circular cross-sectional shape.

11. The flame effect fire of any of claim 1, wherein the wick is planar in shape.

12. The flame effect fire of claim 11, wherein the wick comprises a rectangular sheet.

13. The flame effect fire of claim 7, wherein the wick is planar in shape and the heating element is coplanar with the wick.

14. The flame effect fire of claim 11, wherein the surface of the wick is ash-colored.

15. The flame effect fire of claim 1, wherein the wick comprises a porous material.

16. The flame effect fire of claim 1 wherein the light source is arranged proximate to the distal end of the wick.

17. The flame effect fire of claim 1, wherein the light source is configured to extend along and be parallel with a longitudinal axis of the wick.

18. The flame effect fire of claim 1, wherein the light source is disposed on the fuel bed.

19. The flame effect fire of claim 1, wherein the light source is multi-colored.

20. The flame effect fire of claim 1, wherein the light source comprises one or more lighting elements.

21. The flame effect fire of claim 20, wherein the light source is configured to direct light at the generated vapor at a plurality of angles.

22. The flame effect fire of claim 21, wherein the one or more lighting elements comprise at least one LED.

23. The flame effect fire of claim 20, wherein the lighting elements are configured to be independently controllable such that pulsating or flicker effects within the illuminated vapor can be generated.

24. The flame effect fire of claim 1, comprising a plurality of wicks.

25. The flame effect fire of claim 24, wherein the proximal end of each of the plurality of wicks is disposed in a common reservoir.

26. The flame effect fire of claim 24, wherein a single heating element is provided for the plurality of wicks.

27. The flame effect fire of claim 24, wherein a common heating element is provided for a subset of the plurality of wicks.

28. The flame effect fire of claim 24, wherein a heating element is provided for a respective one of each of the wicks.

29. The flame effect fire of claim 1, wherein the liquid reservoir is positioned beneath the fuel bed.

30. The flame effect fire of claim 1, wherein the fuel bed comprises one or more fuel bed elements.

31. The flame effect fire of claim 30, comprising one or more wick modules each comprising the distal end of the at least one wick, the light source and the heating element, disposed relative to the one or more fuel bed elements such that a viewer of the fire cannot see the one or more wick modules.

32. The flame effect fire of claim 31, wherein at least one of the one or more wick modules is arranged relative to the one or more fuel bed elements so as to be not visible from a front of the fire.

33. The flame effect fire of claim 31, wherein at least one of the one or more wick modules is disposed behind the one or more fuel bed elements.

34. The flame effect fire of claim 31, wherein at least one of the one or more wick modules is attached to a respective one or more of the fuel bed elements.

35. The flame effect fire of claim 31, wherein at least one of the one or more wick modules is embedded within a respective one or more of the fuel bed elements.

36. The flame effect fire of claim 35, wherein each of the one or more fuel bed elements is hollow.

37. The flame effect fire of claim 30, wherein each of the fuel bed elements comprises a log formed of wick absorbing material.

38. The flame effect fire of claim 37, wherein the heating element comprises wiring elements in the wick absorbing material.

39. The flame effect fire of claim 38, wherein the wiring elements are disposed in selective areas of the wick absorbing material.

40. The flame effect fire of claim 37 wherein each of the fuel bed elements is formed from a material blank with fuel effect images printed on a surface thereof.

41. The flame effect fire of claim 37, wherein each of the fuel bed elements comprises a projection constituting the proximal end of the wick.

42. The flame effect fire of claim 30, wherein each of the one or more fuel bed elements comprises one or more apertures.

43. The flame effect fire of claim 1, wherein the fuel bed comprises one or more apertures for the one or more wicks to access the liquid in the reservoir.

44. The flame effect fire of claim 43, wherein the one more apertures in the fuel bed are formed in a base of the fuel bed.

45. The flame effect fire of claim 43, wherein at least one of the apertures in the fuel bed elements is in communication with at least one of the apertures in the fuel bed.

46. The flame effect fire of claim 30, wherein the light source is disposed at one end of each of the one or more fuel bed elements.

47. The flame effect fire of claim 46, wherein internal surfaces of the fuel bed elements act as waveguides to distribute the light through the fuel bed elements.

48. The flame effect fire of claim 1, further comprising a connector which may be unplugged from the light source thereby operably allowing the light source to be separated from its power source and moveable relative to the fuel bed.

49. The flame effect fire of claim 1, wherein the fuel bed is configured to be moveable relative to the light source such that on moving the fuel bed, the light source is exposed.

50. The flame effect fire of claim 1, wherein the light source fulfils a dual function, that of a light source and a heat source.

51. The flame effect fire of claim 1 wherein the fuel bed is illuminated to create the illusion of a burning element.

* * * * *